US012369666B2

(12) United States Patent
Adkins

(10) Patent No.: US 12,369,666 B2
(45) **Date of Patent: *Jul. 29, 2025**

(54) HAIR AND EDGE MAINTENANCE CAP

(71) Applicant: Jennipher Adkins, Chicago, IL (US)

(72) Inventor: Jennipher Adkins, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/520,871

(22) Filed: Nov. 28, 2023

(65) Prior Publication Data

US 2024/0090608 A1 Mar. 21, 2024

Related U.S. Application Data

(60) Continuation of application No. 17/461,421, filed on Aug. 30, 2021, now Pat. No. 11,857,016, which is a division of application No. 15/935,681, filed on Mar. 26, 2018, now abandoned, which is a continuation-in-part of application No. 15/859,530, filed on Dec. 31, 2017, now abandoned.

(51) Int. Cl.

| | |
|---|---|
| ***A42B 1/041*** | (2021.01) |
| ***A42B 1/049*** | (2021.01) |
| ***A42B 1/206*** | (2021.01) |
| ***A42B 1/22*** | (2006.01) |

(52) U.S. Cl.

CPC ..... *A42B 1/041* (2013.01); *A42B 1/049* (2021.01); *A42B 1/206* (2013.01); *A42B 1/22* (2013.01)

(58) Field of Classification Search

CPC ..... A42B 1/206; A42B 1/22; A42B 1/041; A42B 1/12; A42B 1/049; A45D 8/40; A45D 8/36; A45D 19/18; A45D 2/46

USPC ..... 2/68, 171.2, 209.11

See application file for complete search history.

(56) References Cited

U.S. PATENT DOCUMENTS

| | | | | |
|---|---|---|---|---|
| 608,724 | A | 8/1898 | Stader | |
| 1,172,927 | A | 7/1915 | Bloch | |
| 1,300,644 | A | 4/1919 | Philips | |
| 1,350,776 | A | 8/1920 | Brogden | |
| 1,602,889 | A | 10/1926 | Epstein | |
| 2,052,123 | A | 8/1936 | Adamson | |
| 2,069,020 | A | 1/1937 | Schuessler | |
| 2,211,184 | A * | 8/1940 | Varell | A42B 1/041 D2/871 |
| 2,356,042 | A | 8/1944 | Ferber | |

(Continued)

FOREIGN PATENT DOCUMENTS

KR 100779619 B1 * 11/2007 ..... A45D 44/12

*Primary Examiner* — Aiying Zhao

(74) *Attorney, Agent, or Firm* — Faegre Drinker Biddle & Reath LLP

(57) ABSTRACT

A head covering garment includes two exterior components and a stretchable band. The garment is formed by folding a rectangular stretchable material in half and sewing side edges, except for a small portion which is left unattached, to create a stretchable band. Next, at least two exterior components are then sewn to the top and bottom edge portions of the stretchable material. The exterior components and the stretchable material are pulled through the opening left at the unattached portion in the stretchable material and the opening is finally sewn to form the finished garment. The additional versions of the head covering garment comprise of an opening in the stretchable band, a slip proof material, a storage strap, and a hairline treatment strip insert.

13 Claims, 4 Drawing Sheets

(56) References Cited

U.S. PATENT DOCUMENTS

| | | | | | |
|---|---|---|---|---|---|
| 2,604,630 | A | | 7/1952 | Waring | |
| 3,187,345 | A | * | 6/1965 | Holford | A42B 1/206 2/200.1 |
| 3,556,115 | A | | 1/1971 | Benson | |
| 4,190,907 | A | * | 3/1980 | Cruickshank | A42B 1/041 2/202 |
| 5,477,561 | A | * | 12/1995 | Adkins | A42B 1/041 2/171.04 |
| 5,826,277 | A | * | 10/1998 | McConville | A61F 13/01008 2/184 |
| 6,026,514 | A | | 2/2000 | Fricker | |
| 6,936,269 | B2 | | 8/2005 | Robinson | |
| 7,424,751 | B1 | | 9/2008 | Miller | |
| 11,857,016 | B2 | * | 1/2024 | Adkins | A42B 1/22 |
| 2002/0104150 | A1 | | 8/2002 | Hill | |
| 2005/0144702 | A1 | | 7/2005 | Whitney | |
| 2015/0047098 | A1 | | 2/2015 | Pickett | |
| 2017/0354191 | A1 | | 12/2017 | Maring | |
| 2019/0045902 | A1 | | 2/2019 | Baker | |
| 2019/0200695 | A1 | | 7/2019 | Adkins | |
| 2021/0386150 | A1 | | 12/2021 | Adkins | |

* cited by examiner

HAIR AND EDGE MAINTENANCE CAP

RELATED APPLICATIONS

This application is a continuation application of U.S. application Ser. No. 17/461,421, filed Aug. 30, 2021, which is a divisional application of U.S. application Ser. No. 15/935,681, filed Mar. 26, 2018, which is a Continuation in Part of U.S. application Ser. No. 15/859,530, filed Dec. 31, 2017, the disclosures of which are expressly incorporated by reference herein in their entireties.

BACKGROUND OF THE INVENTION

Field of the Invention

The present invention relates to a night and daytime hair maintenance cap. This cap is designed for all hair types.

Description of Related Art

Creators of head garments are always attempting to create a useful garment that will both cover and protect the hair while providing style.

The prior art patents pertaining to head garments are as follows:

U.S. Pat. No. 5,477,561 A, titled HAIR MAINTENANCE HAT, granted to me, 1995 is a head garment that comprises an inner lining and an outer fabric attached to a wide band. This invention comprises of seams that touch the hairline and the edges and therefore does not provide optimal effects to maintain or "lay down" edges while sleep or during use.

U.S. Pat. No. 1,300,644, titled HAT, assigned to Phillips, 1919 is primarily an outdoor hat, containing stand-up brims and crowns for the purpose of outdoor use that can be folded and easily stored. This invention's purpose is to offer users a fashion hat, not a hair maintenance system to wear while sleeping. Furthermore, the lining described in this patent is non-specific (see line 97), and a satin lining is not required.

U.S. Pat. No. 1,350,776, titled BATHING HAT, assigned to Brogen, 1920, is a hat for swimming in. The intentions and purposes of this invention is to prevent water from touching the hair while swimming. It is constructed of a waterproof material, which would cause the head to sweat while sleeping. This hat also has several elastic bands throughout its interior to keep the hat in place, which would not allow for comfort, or a protective, maintaining lining while sleeping.

U.S. Pat. No. 1,602,889, tilted LADY'S CAP, assigned to Epstein, 1928, is a reversible cap with a stated intention and purpose as being for fashion. No satin lining or utility for this invention was stated in the patent. Perhaps what makes this invention unique is the design. However fashionable, it does not offer sleeping comfort, and with its special fastening feature, it is not an easy one step for putting on and taking off.

U.S. Pat. No. 2,052,123, titled FLEXIBLE READWEAR, assigned to Adamson, 1936, is a beret consisting of a thick sweat band (see lines 40-45), that can also have a visor attached to the crown. This unisex cap does not cover the entire head of hair and is primarily for outdoor wear, not to be used as a hair maintenance item.

U.S. Pat. No. 2,356,042, titled COMBINATION NON-ELASTIC ADJUSTABLE HAT BAND AND BOW TRIM HAT, assigned to Ferber, 1944, is a hat with bands that may be adjusted. This hat is designed primarily for outdoor use. It is not intended to cover the entire head of hair, and is not lined with satin. Nor is it designed to securely stay on the head, therefore not intended to be used as a hair maintenance item or to be worn while sleeping.

U.S. Pat. No. 3,556,115, titled COIFFURE PROTECTOR, assigned to Benson, 1971, is large protective coiffure hat. The coiffure hairstyle is not a much worn hairstyle today. This invention is awkward and nonservicable to hairstyles of today. It is comprised of stiff side, front and back walls to give support to coiffure, thus making it unattractive to wear outdoors.

It has been widely accepted that, full and proper hair maintenance is signaled by the condition and appearance of a person's hairline and not solely the hair.

SUMMARY OF INVENTION

The current invention provides maintenance during sleep and yet can be worn outdoors. Other benefits include added maintenance to the hair line or "edges," while simultaneously providing maintenance benefits to the entire head of hair. There is nothing currently on the market that offers comfort, utility, and versatility as the present invention. Disclosed herein are examples and embodiments of an innovative hair maintenance garment that is easy to put on, securely lays down edges and hairline while covering the entire head of hair. The present invention is for all hairstyles.

The objective of this invention is to provide a cap that is worn day or night to maintain the hair, edges, and the hairline, especially at on the front and back of the head. Another objective is to provide multiple styles, shapes and fabrics within one head garment to allow the wearer to attractively use the head garment outdoors as a fashion hat. The seamless stretchable band and components act as a seal keeping the cap on the head comfortably, service and maintain edges, without slipping off.

This invention is a multi-purpose head garment that allows users to maintain their hairline, natural hair and faux hair in various ways. This is partly achieved by using a middle, seamless, extra wide stretchable headband. One edge of the headband is connected to a first exterior component. The other edge is connected to a second exterior component. Both the first and second exterior components can comprise of various shapes, colors and fabrics and can be used as interior or exterior garment. The middle stretchable band strategically lays down on, defines, and maintains the hairline at the front, top of the head, parietal ridge, temple, and nape.

The crown portion of the head is covered by the attached exterior component. One of the objectives of the current invention is to provide multiple head garments that strategically targets the front and the hair line with different holding mechanisms than the crown. Current hair maintenance garments uses a single interior fabric. Additionally, current garments have seams at the hairline, which serve as a disservice to the maintenance of the same. The current invention has removed such seams from the components for optimal hair maintenance, especially the hairline.

Therefore, another objective of the current invention to create options for caring for natural hair. Maintaining moisture is most critical. It is also important to create an environment of comfort and care, that over time delicate areas like the hairline are addressed and treated if needed daily, minus destructive friction caused by seams.

Further, an opening in the current invention's head band and the creation of a hair line or edge strap will provide daily users an effective way to achieve optimal results that addresses this critical area that has not received this level of attention until now.

DESCRIPTION OF PREFERRED EMBODIMENTS

Figure 1:
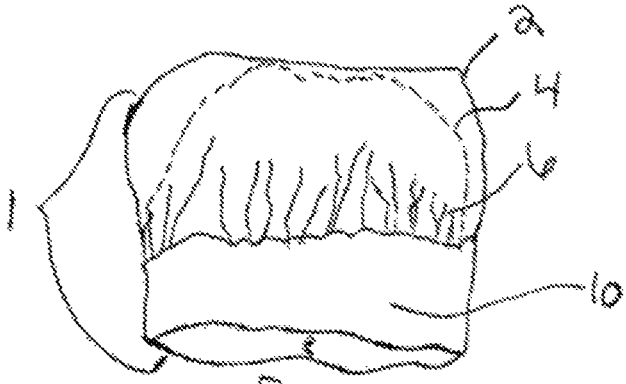
FIG. 1 is a perspective view of head covering garment 1 with all components pulled through sealed opening, in accordance with the present invention.
Figure 6:
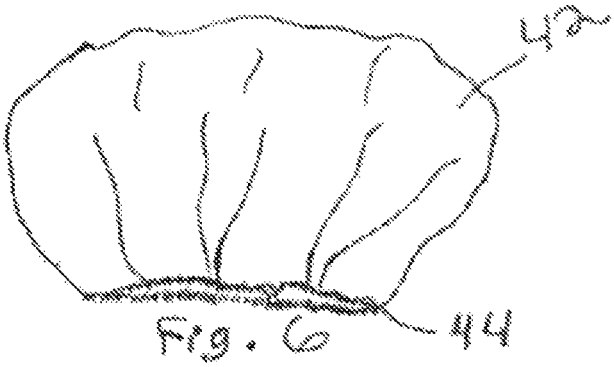
FIG. 6 is a perspective view of an exterior component after partially sewing.
Figure 7:
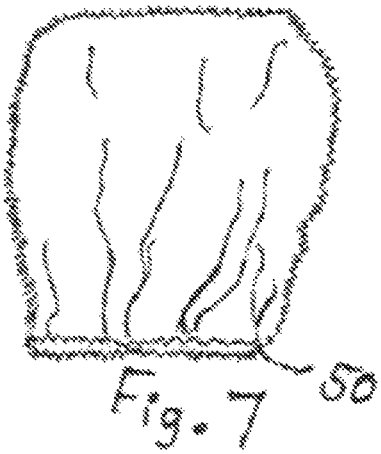
FIG. 7 is a perspective view of an exterior component after partially sewing.

Referring now to the drawings, a head covering garment 1 constructed in accordance with the present invention is generally indicated. FIG. 1 shows one embodiment of a head covering garment 1, for example a hat, as it would be worn by a user. The hat (i.e. the head covering garment) is shown as having two exterior components 2,4. This view shows exterior component 2 as the selected appearance. Each edge of the exterior components 44, 50 in FIGS. 6 and 7 are attached to a respective edge 54, 56 in FIG. 8 of the stretchable band.

Figure 2:
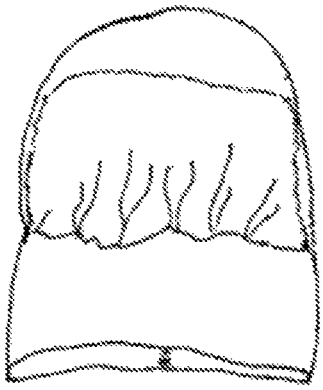
FIG. 2 is a perspective view of head covering garment with all components pulled through sealed opening, in accordance with the present invention.

FIG. 2 shows the alternate selection of the exterior component 4 as shown in FIG. 1. Multiple exterior component options provide the user with an assortment of styles, fabrics and maintenance options within one hat. This is partially achieved by allowing the user to simply collapse the hat by inserting one exterior component option within the other exterior component option. By doing so, this action also creates a fold within the stretchable band. A variety of materials can be employed depending on the style desired by the wearer.

Figure 3:
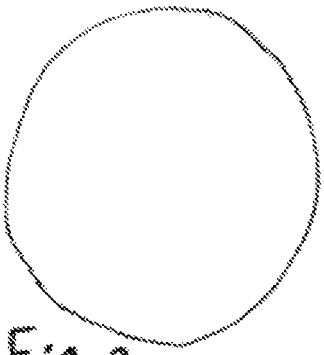
FIG. 3 is a top view of an unsewn exterior component.

In FIG. 3, this exterior component option is made from a circular piece of material.

Figure 4:
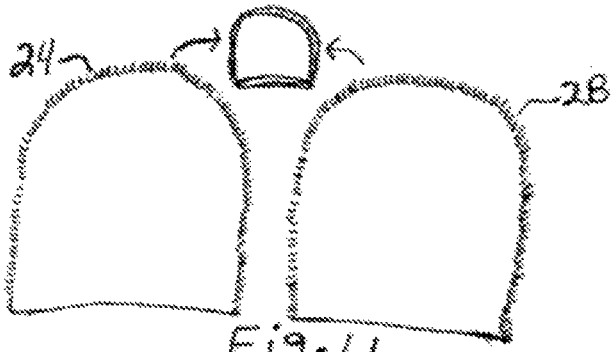
FIG. 4 is a top view of exterior components.

In FIG. 4 another example of the exterior component is shown. For example, this example shows a "ski" cap design, whereby the edges 24, 28 of the exterior component pieces must first be sewn prior to attaching the exterior component to the stretchable band. It should be noted that one of the exterior components can also serve as a lining, where the lining material is preferably made from a fabric that serves as hair maintenance, for example satin, silk or any material that lays down the hair.

Figure 5:
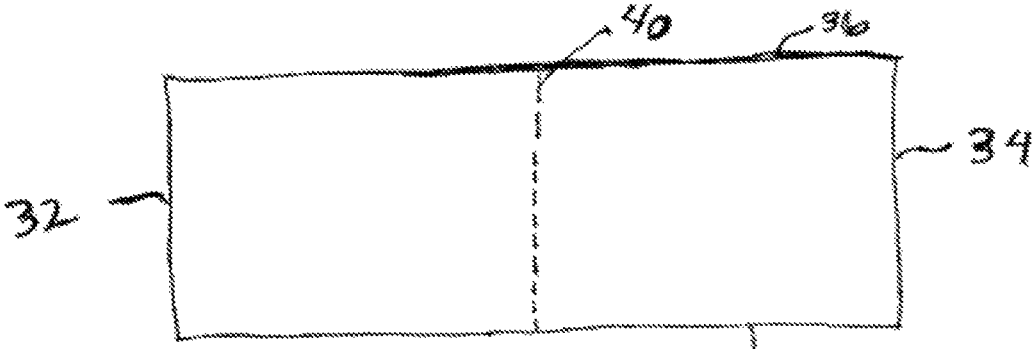
FIG. 5 is a perspective view of a stretchable band of the present invention prior to sewing.
Figure 8:
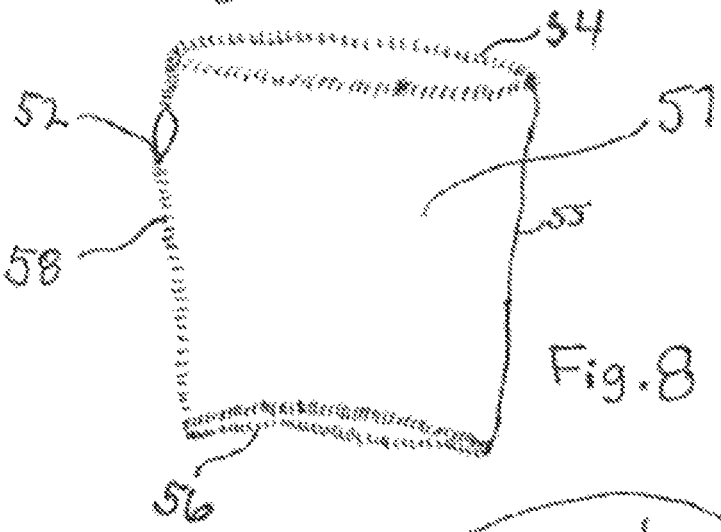
FIG. 8 is a perspective view of the stretchable band of the present invention after sewing.

FIG. 5 shows the stretchable band of the present invention. The band is rectangular in shape and has two end portions 32, 34 as well as a top edge portion 36 and a bottom edge portion 38. The band is folded along a vertical line 40. The end portions 32, 34 of the stretchable band are partially sewn together to form a seam 58 to create a loop as seen in FIG. 8. The edges 44, 50 of the exterior components in FIGS. 6 and 7 can be attached. There can be an optional, temporary opening 52 to allow exterior components to be pulled through. Once pulled through, the seams of the components are hidden. The temporary opening is then sealed. FIG. 6 shows an exterior component 42 created from a circular material with gathered bottom edge 44.

In FIG. 7 yet another exterior option is shown. The bottom edge 50 is also gathered so that it can stretch when attached to the stretchable band 57.

FIG. 8 is an unattached stretch band in accordance with present invention. Also shown is an optional opening 52 in seam 58.

Figure 9:
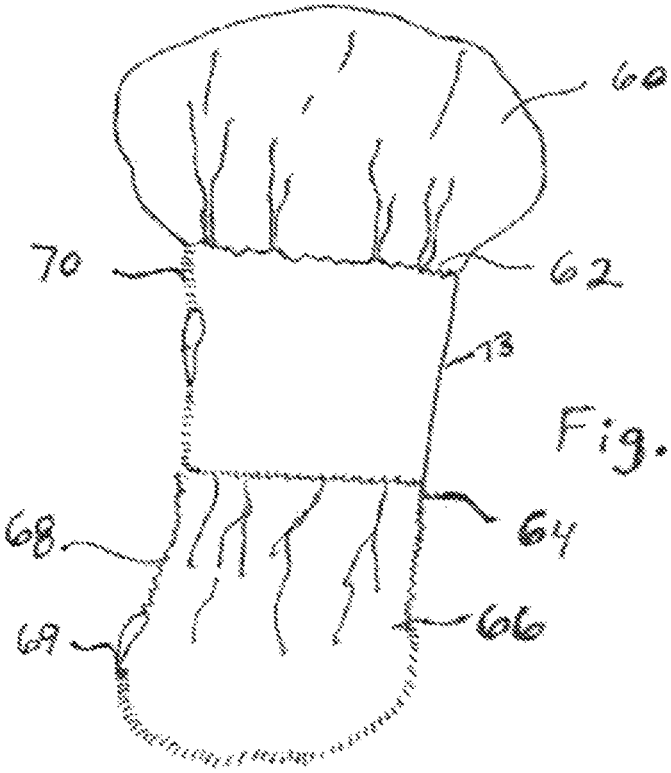
FIG. 9 is a perspective view of head covering garment according to the invention after sewing all parts together, showing component not pulled through opening.

Moving now to FIG. 9, a completely attached version of a head covering garment according to the current invention is shown, whereby the exterior component 60 is attached to an edge 62 of a folded stretchable band 73. The other attached exterior component 66 is attached to the other end 64 of the stretchable band. Also note that this exterior component has a seam 68, therefore, a portion of the seam, such as an opening 69, can also be used to pull through the attached components to hide all seams. The seam is sealed after all components are pulled through the opening.

Figure 10:
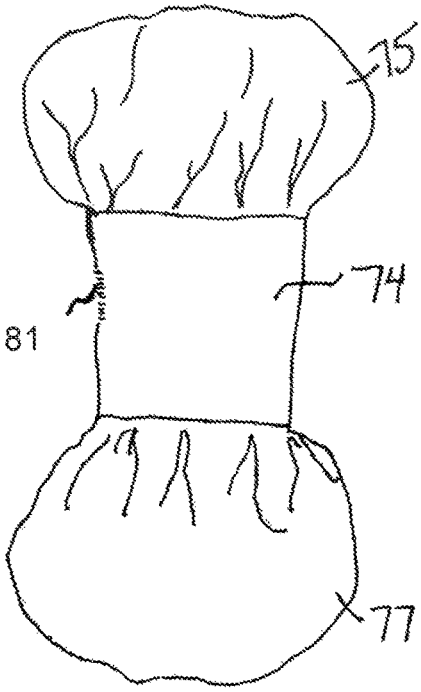
FIG. 10 is a flat view of head covering garment according to the invention after sewing all parts together, showing components pulled through sealed opening to enclose seams, further showing similar exterior shapes.

FIG. 10. shows an example of the current invention, with both exterior components attached and pulled through opening. The version shown here illustrates two exterior components created from circular material as shown in FIG. 3. The opening in the stretchable band is also sealed to form a sealed opening 81. The completed garment creates a hollow envelope with a stretchable band 74 and two ends 75, 77 or exterior components. The garment is worn by housing one exterior component inside the opposite end, thereby creating the folded stretchable band 10. When the head covering garment is placed on the head, the stretchable band generously covers top of head, and front and back hairline.

Figure 11:
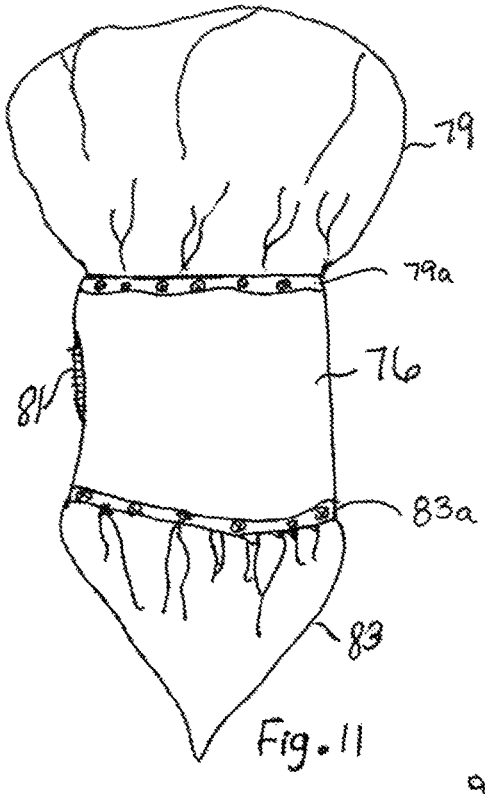
FIG. 11 is a flat view of head covering garment according to the invention after sewing all parts together, showing components pulled through sealed opening to enclose seams, further showing different exterior shapes.

FIG. 11 shows yet another frontal view of the current invention, with both exterior components attached and pulled through a sealed opening 81. The version shown here illustrates two exterior components, one created from circular material as shown in FIG. 3 and an exterior option that is triangular shaped (i.e. a santa hat). Also shown are the removable attached exterior components 79*a*, 83*a*, wherein user is able to detach the exterior, thereby creating more selection.

Figure 12:
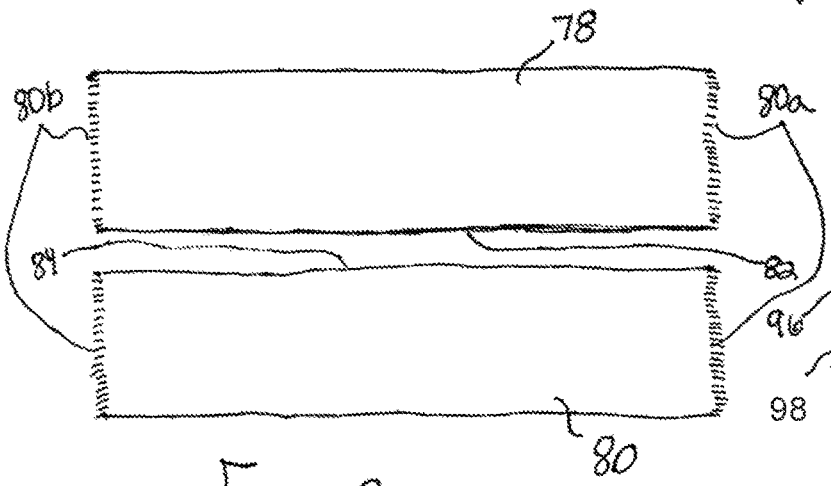
FIG. 12 is a flat view of view of stretchable band components.
Figure 13:
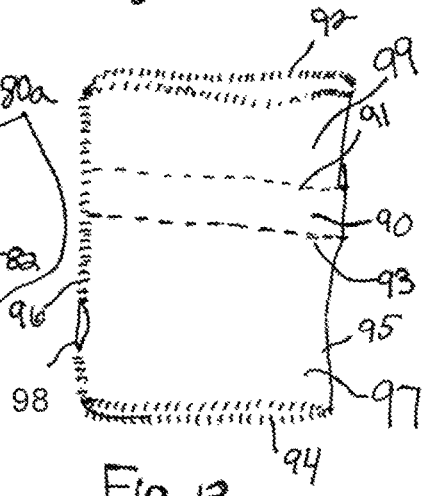
FIG. 13 is a perspective view of partially sewn stretchable band components that further comprise a circumference opening

FIGS. 12 and 13 show the stretchable band formed from two band components (78 and 80 in FIG. 12, or 97 and 99 in FIG. 13). In forming the stretchable band, the two band components (a first band component 80, 97 and a second band component 78, 99) are folded in half along the vertical center line 95. The band component 78, 99 has a horizontal edge 82 or 93, another horizontal edge 92, a first vertical edge 80*a*, and a second vertical edge 80*b*. The band component 80 has a horizontal edge 84 or 91, another horizontal edge 94, a first vertical edge 80*a*, and a second vertical edge 80*b*. After folding, the center or horizontal edges 82, 93 (of the band component 78, 99), and 84 or 91 (of the band component 80, 97) are overlapped before the vertical edges 80*a* and 80*b* of the band components 78, 99 and 80, 97 are partially attached or sewn together to form a vertical seam 96 and to define a vertical opening 98. The vertical seam 96 allows the horizontal edge 84, 91 of one stretchable band component 80, 97 to be situated over the horizontal edge 82, 93 of a second stretchable band component 78, 99. The horizontal edge 91 of the band component 97 overlaps with the band component 99, and the horizontal edge 93 of the band component 99 overlaps with the band component 97, to define a horizontal opening 90 where the band components 97 and 99 partially overlap.

In FIG. 13, a first stretchable band component 80, 97 is shown partially overlapping a second stretchable band component 78, 99. The overlapped edge 91 (of the first stretchable band component 97) and the overlapped edge 93 (of the second stretchable band component 99) create an access site therebetween, formed by the horizontal opening 90 that appears closed due to the doubled over material of the band components 97 and 99. The horizontal edges 92, 94 of the first and second band components are sewn or attached to the edges 44, 50 (shown in FIGS. 6 and 7, respectively) of exterior components. If necessary, components are pulled through the vertical opening 98 to complete garment before sealing the vertical opening 98. The vertical opening 98 as shown in the example of FIG. 13 is defined solely by the first band component 97.

Figure 14:
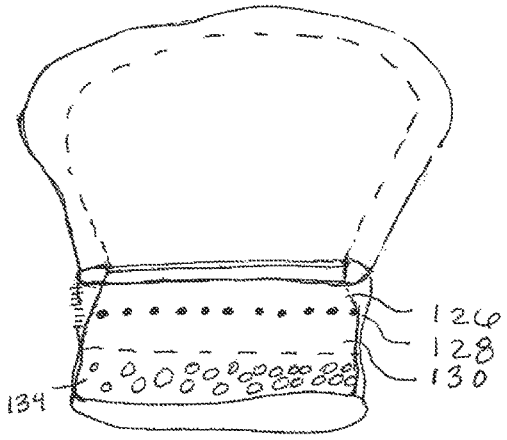
FIG. 14 is a perspective view of the head covering garment, with all components pulled through sealed opening, further showing opening in stretchable band in accordance with the present invention.

FIG. 14 shows a perspective view of a fully sewn or attached head covering garment in accordance with present invention that comprises a stretchable band with an opening. It should be noted that the preferred material for at least the inside of the opened stretchable band material 78, 80 should be of a porous form and thin (such as stretch mesh, sheers) to allow user to insert an edge treatment strip 108, 134 that comprises hair setting agents commonly used today in the treatment of edge and hairline issues such as taming edges, thinning, greying and hair loss. The treatment strip 108, 134 would be inserted via the opening 128 in the stretchable band. The connection of the overlapped edges 126 would assist in securely housing the strip 108, 134 inside the stretchable band envelope 130.

Figure 15:
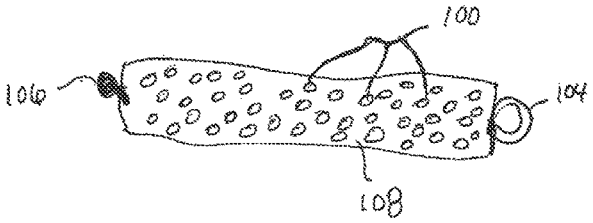
FIG. 15 is a perspective view of treatment strip insert that further comprises an attaching mechanism.

FIG. 15 further shows a frontal view of an infused hairline or edge treatment strip 108 that further comprises solution holding cavities 100 and an attaching mechanism 104, 106 that will provide options, whereby user can opt to attach strip directly onto the head using an attaching mechanism or insert strip inside housing of stretchable band. It should be noted that the current invention will create enhanced results relative to edge maintenance with the use of commonly used edge formulations on the market today and in conjunction with the utilization of the present invention's stretchable band and edge strip application, whereby, the additional pressing provided by a deliberate stretchable band will not only train untamed edges but will also strategically stretch or flatten the edges more effectively over time thereby achieving more effective, long term results. The current invention will also serve as a more effect treatment delivery system for issues such as thinning, graying or hair loss because now the user can uniquely target the hairline exclusively during sleep and while using current invention while simultaneously protecting entire head of hair.

Figure 16:
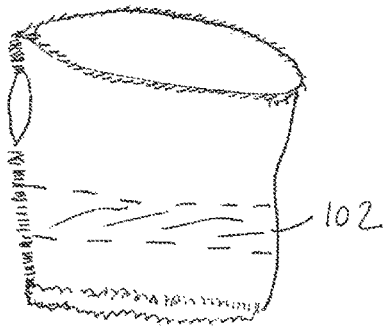
FIG. 16 is a perspective view of a stretchable band of the present invention after partially sewing, further comprising slip proof silicon or other substance that can secure the stretchable band on hairline.

In FIG. 16 a partially sewn stretchable band is shown that further comprises skin and hair adhesion material 102, (such as rubber, silicon or other pliable, soft material that also "grips" and controls while remaining in place), thereby allowing the user to strategically place this specified adhesion material 102 onto hairline for purposes of added maintenance and control of edges of hair and entire hair line. For added benefits, user may also opt to add specially formulated wet products and formulas that contain setting agents to thereby allow the adhesion material to stretch and relax hair edges and hair line more efficiently. Exterior components are attached in accordance with present invention.

Figure 17:
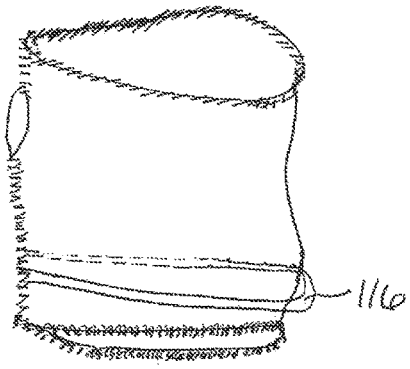
FIG. 17 is a perspective view of a stretchable band of the present invention after partially sewing, further comprising bundle strap.

In FIG. 17 a partially sewn stretchable band is shown that further comprises bundle strap 116. When not in use, user may opt to securely seal the garment by bundling it with the attached strap 116 thereby keeping dust or any unwanted particles from entering the garment. Additionally, bundling the garment can also securely hold other hair articles, accessories or wet goods as daily storage or during travel. Exterior components are attached in accordance with present invention.

What is claimed is:

1. A method of forming a head covering garment comprising:

providing a first band component and a second band component, the first band component having a first vertical edge, a second vertical edge, a first horizontal edge, and a second horizontal edge, and the second band component having a first vertical edge, a second vertical edge, a first horizontal edge, and a second horizontal edge;

partially overlapping the first and second band components such that the first horizontal edge of the first band component overlaps with the second band component, and the second horizontal edge of the second band component overlaps with the first band component, to define a horizontal opening where the first and second band components partially overlap;

folding the first and second band components in half;

partially attaching the first and second vertical edges of the first and second band components together to define a vertical opening between the first and second vertical edges;

attaching a first exterior component to the first horizontal edge of the second band component; and attaching a second exterior component to the second horizontal edge of the first band component.

2. The method of claim 1, further comprising:

disposing a removable treatment strip in the horizontal opening, the removable treatment strip configured to apply a treatment solution to a hairline of a user.

3. The method of claim 2, wherein the removable treatment strip comprises a plurality of solution-holding cavities.

4. The method of claim 1, further comprising:

pulling the first and second exterior components through the vertical opening.

5. The method of claim 1, further comprising:

providing a strap to bundle the head covering garment.

6. The method of claim 1, further comprising:

providing a slip proof adhesion material to secure the first band component and the second band component on a hairline.

7. The method of claim 1, wherein at least one of the first and second exterior components comprises a removably attachable edge to be removably attached to at least one of the first and second band components.

8. The method of claim 1, wherein at least one of the first and second exterior components comprise an additional vertical opening.

9. The method of claim 1, wherein the first and second exterior components are permanently attached to the first and second band components.

10. The method of claim 1, wherein a shape of the first exterior component is different from that of the second exterior component.

11. The method of claim 1, wherein the first exterior component comprises a lining material.

12. The method of claim 1, wherein the vertical opening is defined solely by the first band component.

13. The method of claim 1, further comprising:

forming, using the horizontal opening, an access site between the first band component and the second band component.

* * * * *